US006279898B1

(12) United States Patent
Stephan

(10) Patent No.: US 6,279,898 B1
(45) **Date of Patent: *Aug. 28, 2001**

(54) AIR CUSHION GUIDE AND METHOD OF ADJUSTING A FLOTATION HEIGHT

(75) Inventor: Günter Stephan, Wiesloch (DE)

(73) Assignee: Heidelberger Druckmaschinen Aktiengesellschaft, Heidelberg (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/143,123

(22) Filed: Aug. 28, 1998

(30) Foreign Application Priority Data

Aug. 28, 1997 (DE) ..... 197 37 564
Oct. 24, 1997 (DE) ..... 197 47 040

(51) Int. Cl.[7] ..... B65H 5/16
(52) U.S. Cl. ..... 271/195; 271/82
(58) Field of Search ..... 271/194, 195, 271/82; 406/86, 88

(56) References Cited

U.S. PATENT DOCUMENTS 4,099,463 * 7/1978 Zimmermann et al. ..... 271/195
4,688,784 * 8/1987 Wirz ..... 271/195
5,209,387 * 5/1993 Long et al. ..... 406/88
5,411,251 * 5/1995 Schmid et al. ..... 271/195
5,582,400 * 12/1996 Seydel ..... 271/195
5,634,636 6/1997 Jackson et al. .
5,797,327 * 8/1998 Gieser et al. ..... 271/195
5,931,093 * 8/1999 Walther et al. ..... 271/195

FOREIGN PATENT DOCUMENTS 34 31 125 A1 3/1986 (DE) .
0 156 173 A2 10/1985 (EP) .
0 183 928 A2 6/1986 (EP) .

OTHER PUBLICATIONS

German Utility Model No. 295 01 537.3, dated Apr. 20, 1995, sheet guiding device with air supply boxes.

* cited by examiner

*Primary Examiner*—H. Grant Skaggs
(74) *Attorney, Agent, or Firm*—Herbert L. Lerner; Laurence A. Greenberg; Werner H Stemer

(57) ABSTRACT

An air cushion guide for sheet or web-formed material includes at least one guide member formed with nozzle openings through which air is blown between the guide member and the guided material for supporting the guide material on a supporting air cushion located above the guide member, at least one of two variables consisting of volumetric air flow emerging from the nozzles and flow speed between the guide member and the guided material being adjustable independently of one another so that a proportionality between the two variables is nullified or neutralized; and a method of adjusting a flotation height.

17 Claims, 9 Drawing Sheets

12a
12
12c
16a
13b
16b
13
16c
13a
14a
15a
14b
17
14c
15b
18
15c
19

AIR CUSHION GUIDE AND METHOD OF ADJUSTING A FLOTATION HEIGHT

BACKGROUND OF THE INVENTION

Field of the Invention

The invention relates to an air cushion guide for sheet or web-formed material, in particular for printed paper sheets in a printing press, by which guided sheet or web-formed material is supported on a supporting air cushion above at least one guide body or guide member formed with nozzle openings through which air is blown between the guide body or member and the guided material; and a method of adjusting a flotation or suspension height of a sheet or web-formed material.

Such air cushion guides have been described, for example, in the published German Patent Documents DE 44 27 448 A1 and DE 42 42 730 A1. In a most varied form and design, they are used, among other purposes, for transporting freshly printed and yet wet sheets of paper in a delivery system of offset printing presses, for example, in a contact-free manner from a printing unit to a delivery pile or, in sheet turning or reversing devices, for transporting sheets to sheet transfer drums or the like, between two impression cylinders. In this regard, a problem arises that, depending upon the printing job, quite different types of paper, sometimes printed on both sides thereof, have to be fed safely, i.e., without smearing. However, with an air cushion guide of fixed characteristics, which are determined by the number and form of the nozzles and by the amount of air blown through the nozzles, this cannot be assured in a like manner for all types of paper.

In general, one would assume that the risk of smearing would be all the less, the greater the height at which the sheet floats above the guide members. This is not quite true, however, because, in air cushion guides which operate on the principle of the hydrodynamic paradox, stability of guidance depends upon the height of the air cushion. Thicker air cushions are less stable, i.e., the restoring forces exerted by the air cushion on the guided sheets when changes in spacing occur are much less thereat than in floating guides where there is only a slight spacing between the guide member and the sheets and where, because of a high flow speed of the air flowing out of the nozzles, the guided sheet is guided quite stably, that is, with high restoring forces. The latter is the more optimal solution especially for thin, yielding papers, whereas, a too small spacing from the guide baffles is problematic for stiff, thick paper qualiies.

It would therefore be optimal if one could realize an air cushion guide which simultaneously combines both a large spacing of the guided sheet and great stability because of a high flow speed of the blown or blast air under the sheet. It is self-deceiving, however, to assume that this could be achieved with an air cushion operating in accordance with the aerodynamic paradox, by simply "opening up the blower" and thus lifting the sheet by blowing a greater amount of air into the air cushion. This becomes clear from the graph in FIG. 4, wherein the operating conditions of an air cushion guide according to the prior art are shown. Specifically, the curve c thereof shows the dependency of the speed c of the airflow blown through the nozzles into the air cushion, and the curve Q shows the volumetric flow Q, respectively, dependent upon the initial or supply pressure $P_v$ of the chamber in the guide member from which the nozzles are supplied. If the pressure is increased, both variables vary approximately to the same extent or, in other words, approximately proportionally to one another.

Conversely, the flotation height, as the curve h shows, remains virtually the same when pressure variations occur over a relatively wide range between 0.5 millibars (mbar) and 10 mbar.

Because it was consequently impossible to adjust the flotation height of the guided sheets to the various paper qualities by controlling the air compressor used for the air cushion guide, other courses were taken heretofore. For example, the hereinafore mentioned, published German Patent Document DE 42 42 730 A1 teaches disposing the air openings or nozzles in interchangeable replacement cassettes, i.e., matching the air cushion guide to the guide material is accomplished by replacing cassettes. This is unable to be effected during operation of the printing press, however, nor can it be automated.

In the published German Patent Document DE 42 09 167 A1, a sheet guiding device is described wherein the flotation height of the sheet in the middle portion thereof is increased by additional blower nozzles from which airstreams or flows are blown which strike the sheet surface perpendicularly and lift the sheet in the middle thereof by the impulse effect of these additional airstreams. Although this may possibly allow the flotation height or level to be set uniformly over the width of the sheet, it does not produce an overall change in the flotation height.

A combination of nozzles which operate in- accordance with the hydrodynamic paradox, and blower or blast nozzles directed perpendicularly to the guided paper web so as to increase the flotation height of the guided web and make it more uniform have been described for weblike materials hereinbefore in German Patent 17 74 126. However, this reference discloses no possible way of adapting or matching the flotation height to various material qualities during operation of the device.

From German Patent 20 20 430, it has become known heretofore for somewhat airfoil-shaped air cushion guide members, for guiding weblike materials, to be switched over mechanically in such a manner that at least two stable zones are produced for the spacing between the guided web and the guide member. The characteristic of the guide member is varied so that it acts, on the one hand, as an air cushion nozzle and, on the other hand, as an airfoil nozzle, i.e., in accordance with the hydrodynamic paradox. In this regard, however, the greater spacing of the guided part, which results from the air cushion characteristic, is achieved at the cost of reduced stability of the air cushion produced by this type of nozzle.

SUMMARY OF THE INVENTION

It is accordingly an object of the invention of the instant application to provide an air cushion guide which, even during operation, can be adapted or matched to the various properties of the guide materials and, in fact, so that, in particular, the flotation or suspension height of the guided sheet and the guided web, respectively, is also able to be varied by relatively simple automation processes, and to provide, as well, a suitable method for adjusting the flotation height of the guided sheet or web.

With the foregoing and other objects in view, there is provided, in accordance with one aspect of the invention, an air cushion guide for sheet or web-formed material, comprising at least one guide member formed with nozzle openings through which air is blown between the guide member and the guided material for supporting the guide material on a supporting air cushion located above the guide member, at least one of two variables consisting of volumetric air flow emerging from the nozzles and flow speed between the guide member and the guided material being adjustable independently of one another so that a proportionality between the two variables is neutralized or nullified.

In accordance with another feature of the invention, an active number of the nozzle openings covered by the guided material is variable.

In accordance with a further feature of the invention, the guide member has a plurality of groups of the nozzles, each group of the nozzles being supplied with blowing air and being cut off therefrom in a separately connectible and disconnectible manner, respectively.

In accordance with an added feature of the invention, the groups of the nozzles are connected to a common blown air generator via control valves.

In accordance with an additional feature of the invention, each of the groups of the nozzles is connected to a separate blown air generator.

In accordance with yet another feature of the invention, effective cross sections of at least one of the categories of individual ones of the nozzle openings, of individual groups of the nozzle openings, and of all of the nozzle openings are variable.

In accordance with yet a further feature of the invention, the air cushion guide includes electrically actuated movable blocking members for varying the cross sections of the nozzle openings.

In accordance with yet an added feature of the invention, the movable blocking members are selected from the groups consisting of flaps and slides.

In accordance with yet an additional feature of the invention, the nozzles have controllably deformable flaplike, yielding tongues.

In accordance with still another feature of the invention, the air cushion guide includes electrically actuatable adjusting gears for deforming the tongues.

In accordance with still a further feature of the invention, the tongues are formed as bimetal strips, and an airflow heater is provided.

In accordance with still an added feature of the invention, the tongues are deformable under the influence of a pressure difference developing at the nozzles.

In accordance with still an additional feature of the invention, the guide member includes at least two groups of the nozzles, the groups having different consumer characteristic curves, the groups of the nozzles being suppliable by blown air at pressures regulatable independently of one another.

In accordance with another feature of the invention, the sums of throttle areas of the nozzles of both of the groups differ from one another by a factor of at least two.

In accordance with a further feature of the invention, the groups of the nozzles, respectively, are connected to different types of blown air generators.

In accordance with an added feature of the invention, the types of blown air generators are selected from the group consisting of blowers, ejectors and axial fans.

In accordance with an additional feature of the invention, the air cushion guide includes an electronic control unit into which one of a nominal flotation height of the material guided by the air cushion, and of an extent of variation of the nominal flotation height is inputtable as a reference value, the control unit being operatable for ascertaining at least one of a set of controlled values for a variation in air volume flowing out of the nozzle openings, and a variation in flow speed between the guide member and the guide material.

In accordance with another aspect of the invention, there is provided in a delivery system of a sheet-fed offset printing press, an air cushion guide for printed sheet or web-formed material, comprising at least one guide member formed with nozzle openings through which air is blown between the guide member and the guided material for supporting the guide material on a supporting air cushion located above the guide member, at least one of two variables consisting of volumetric air flow emerging from the nozzles and flow speed between the guide member and the guided material being adjustable independently of one another so that a proportiontality between the two variables is neutralized or nullified.

In accordance with a further aspect of the invention, there is provided in a region wherein one of a sheet transfer device and a sheet turning device is located between two impression cylinders of a sheet-fed offset printing press, an air cushion guide for printed sheet or web-formed material, comprising at least one guide member formed with nozzle openings through which air is blown between the guide member and the guided material for supporting the guide material on a supporting air cushion located above the guide member, at least one of two variables consisting of volumetric air flow emerging from the nozzles and flow speed between the guide member and the guided material being adjustable independently of one another so that a proportionality between the two variables is neutralized or nullified.

In accordance with an added aspect of the invention, there is provided a method for adjusting a flotation height of sheet or web material guided in an air cushion guide, which comprises supporting the guide material on a supporting air cushion via at least one guide member, and blowing air beneath the guide material via nozzles in the guide member, a quotient between volumetric air flow blown in through the nozzles, and flow speed of the air between the guide member and the guide material being varied.

In accordance with another mode, wherein the guide member includes at least two groups of nozzles with consumer characteristic curves for each of the groups differing from one another by a factor of at least two, the method includes varying a ratio to one another of the pressures of blowing air with which the groups of nozzles are supplied.

In accordance with a concomitant mode, the method of the invention includes varying effective cross sections of the nozzles or individual groups of the nozzles.

The invention is thus based upon the recognition than the flotation height for an air cushion guide operating in accordance with the hydrodynamic paradox, can be markedly varied only if the proportionality between the volumetric air flow emerging from the nozzles and the flow speed of the air between the guide member and the guide material is neutralized or balanced out. To achieve this, the volumetric air flow and/or the flow speed of the air are adjusted independently of one another, and thus the quotient between these two variables is changed.

By way of this provision, it is not only possible to adjust the flotation height of the guided part to various values while preserving the stability provided by the principle of the hydrodynamic paradox, but also, in addition, by targeted, feedback-free changes in the volumetric air flow and the kinetic energy of the supporting air cushion, the air cushion guide can also be adapted optimally to other factors which occur during operation in printing presses, such as the subject and degree of moisture absorption by the printed sheet, incident centrifugal forces, turbulence, airstreams of hot-air dryers, and so forth. Thus, the pressman is provided with an additional method of exerting influence upon the guide sheet and of optimizing the outcome of the printing process.

One option for independent adjustment of the aforementioned two variables is to vary the number of active nozzle openings covered by the guide material. This occurs, for example, when the guide body includes a plurality of groups of nozzles, and each group of nozzles is supplied with blowing air in a separately connectible and disconnectible manner. The groups of nozzles can be connected to a common blown air generator via control valves, or each group of nozzles can be connected to a separated blown air generator. By press or machine-controlled actuation of the control valves or activation of the blown air generators, the volumetric air flow under the guide material or sheet can thus he increased overall, without any change in the flow speed of the air. In this way, the flotation height of the guide material or sheet is increased without sacrifices of guidance stability.

Analogously, it is possible to vary the effective cross sections of individual nozzle openings, of individual groups of nozzle openings, or of all of the nozzle openings, for example, by electrically actuated flaps, slides, or the like. Thus the nozzles may have flaplike, yielding tongues, which are deformable, for example, via electrically actuatable adjusting gears. If the tongues are suitably formed as bimetal strips, the cross section of the nozzle opening can then also be varied via the temperature of the airstream, or if the tongues are slightly resilient, this can be effected under the influence of the pressure difference that then develops at the nozzles.

In an especially advantageous exemplary embodiment of the invention, the guide members have at least two groups of nozzles, and the groups have different consumer characteristic curves or, in other words, different dependencies of the volumetric flow admitted through the nozzle openings, upon the supply pressure $p_v$1 of air present at the nozzle openings. For example, if the consumer characteristic curves differ by at least a factor of two, then the quotient of the total volumetric flow W blowing into the air cushion, and the flow speed c of the supporting air effectively developing under the guide material, and thus the flotation height, can also be varied by controlling the ratio of the pressures $p_v$1 and $p_v$2 of the two nozzle groups. The degree of influence is naturally greater, the greater the difference between the consumer characteristic curves of the two groups of nozzles, so that it also then becomes expedient to operate the groups of nozzles by different types of blown air generators, such as gas blowers, ejectors or axial fans, which intrinsically make available different magnitudes of initial or supply pressures and volumetric flows.

The embodiment of the invention can be automated especially well, because control of the flotation height requires merely controlling independently of one another the rotary speeds of the blown air generators supplying the two groups of nozzles.

In the interest of producing the simplest possible automation, it is also expedient to provide an electronic control unit, to which the nominal flotation height of the material guided by the air cushion, or the extent of variation thereof, can be input as a reference value, the control unit thereby ascertaining controlled variables for the variation of the air volume flowing out of the nozzle openings and/or the variation of the flow speed between the guide member and the guide material. The ascertainment of the controlled variables can be accomplished based upon families of one or two-dimensional characteristic curves stored in memory beforehand.

Other features which are considered as characteristic for the invention are set forth in the appended claims.

Although the invention is illustrated and described herein as embodied in an air cushion guide and method of adjusting a flotation height, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
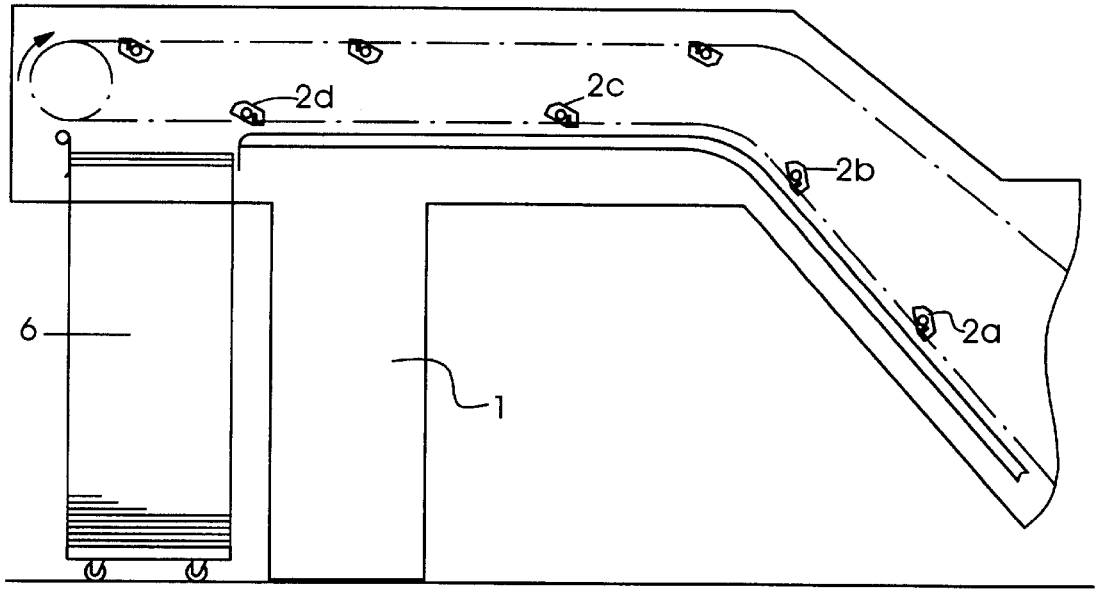
FIG. 1 is a fragmentary diagrammatic side elevational view of a delivery system of a sheet-fed printing press incorporating the features of the invention of the instant application.
Figure 2:
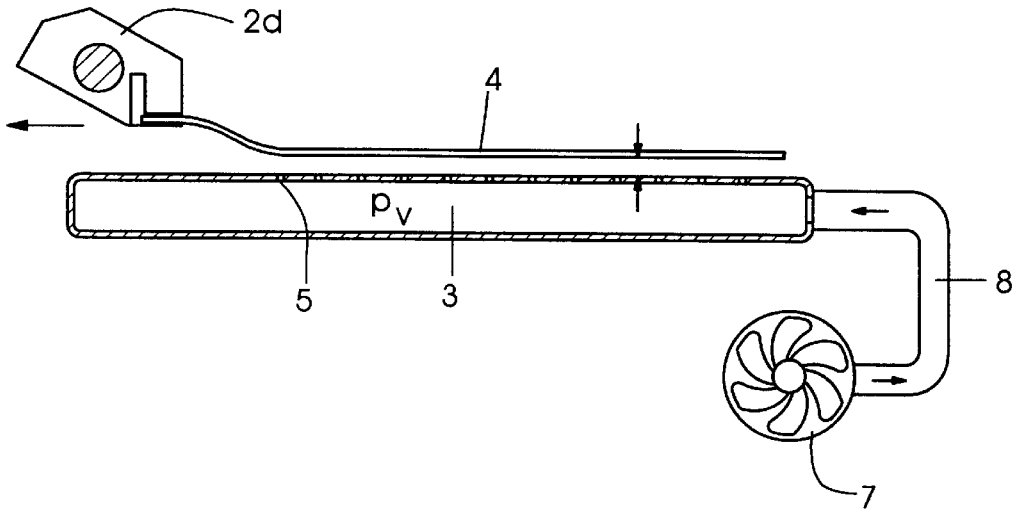
FIG. 2 is a much enlarged fragmentary view of FIG. 1 showing, in greater detail, the sheet guide according to the invention in the vicinity of a gripper of the delivery system.

Referring now to the drawings and, first, particularly to FIG. 1 thereof, there is diagrammatically shown therein a delivery system 1 of a sheet-fed printing press. Therein, paper sheets 4 gripped at leading ends thereof by gripper bars 2 are fed from a non-illustrated last printing unit of the printing press in a direction towards a delivery pile 6 via a so-called guide body or guide member 3. As is apparent from the enlarged view of FIG. 2, the guide member 3 is embodied as a box having a hollow interior into which a blower 7 blows air via a connection line 8, thereby generating an overpressure $p_v$, which escapes via a multiplicity of nozzle openings 5 and thus builds up an air cushion between the respective guide member 3 and the surface thereof, on the one hand, and the underside of the sheet 4 guided thereabove, on the other hand.

Figure 3:
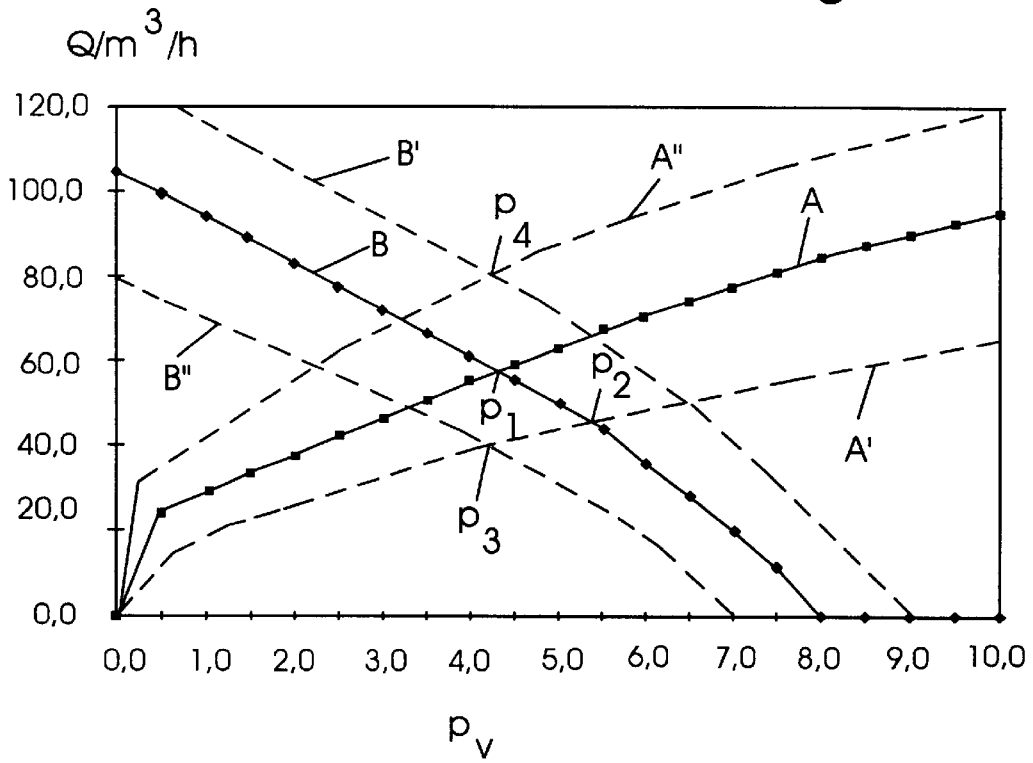
FIG. 3 is a plot diagram or graph showing typical characteristic curves of an air generator or blower and a consumer.

In the plot diagram or graph of FIG. 3, by way of example, characteristic curves of the two essential components of an air cushion guide are shown, namely that for a typical air generator, i.e., a blower, represented by curve B, and that of a consumer, i.e., a number of nozzle openings in a guide member, represented by curve A. In each case, the volumetric flow Q generated by the generator, and the volumetric flow through the consumer, respectively, are plotted as functions of the pressure $p_v$, i.e., the pressure at the consumer acting as a throttle, and of the pressure difference from the generator at the consumer because of the throttling action. The characteristic curve of the consumer having the nozzle openings acting as a throttle (curve A) begins at the zero point and then rises. The characteristic curve of the ad r generator (curve B), conversely, attains the maximal pressure thereof when the volumetric flow, because of the throttling action of the consumer, tends toward zero, i.e., in the case wherein all of the nozzle openings are closed. The resultant operating point $p_1$ of the air cushion guide takes the form of an intersection of the characteristic curves B of the air generator and A of the air consumer.

Figure 4:
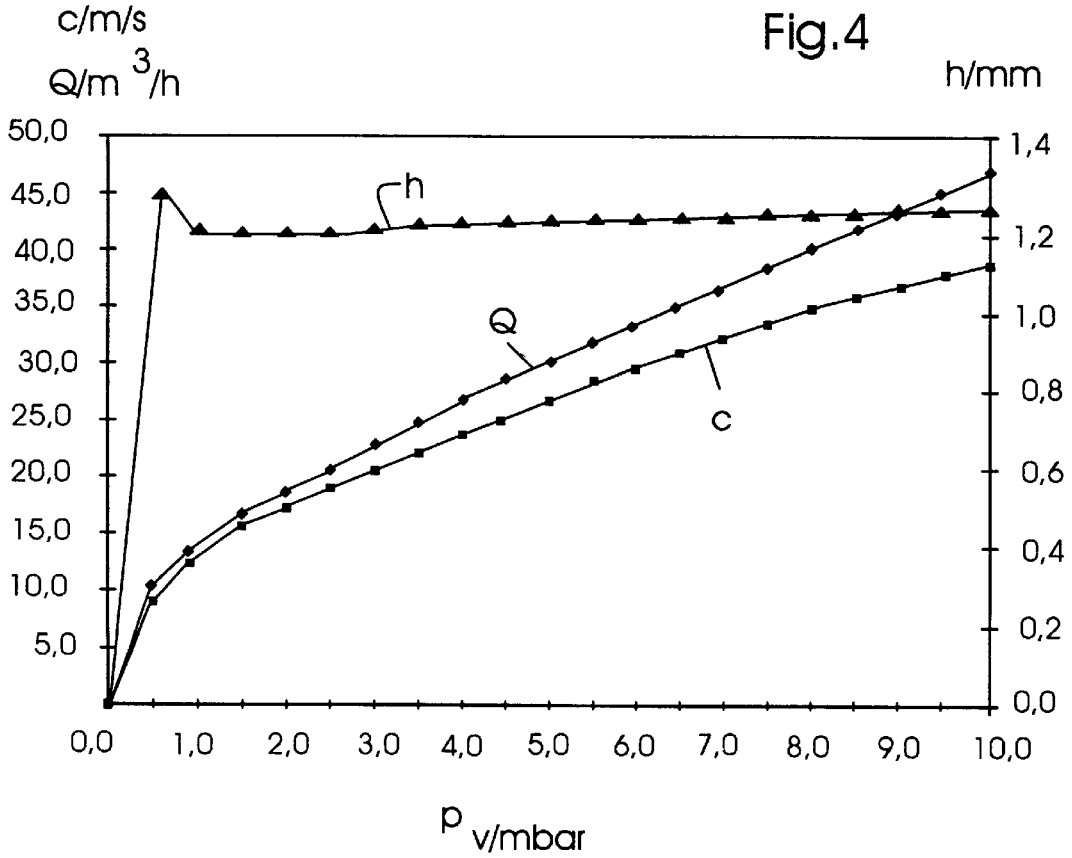
FIG. 4 is a plot diagram or graph showing, for a typical air cushion guide, the dependency of flow speed c, volumetric flow Q, and flotation level or height h of the guided sheet upon the initial or supply pressure $p_v$ at the blower nozzles.

If the power of the generator is varied, for example, by varying the rotary speed of the blower, by throttling in the feed line to the consumer, or by a bypass around the consumer line, then the generator characteristic curve does, in fact, change, as indicated by the curves B' and B" shown in broken lines in FIG. 1. The intersections with the unchanged consumer characteristic curve become operating points for the air cushion characteristic curve, however. Accordingly, by varying the power of the blower, as represented by the curve A shown in a solid or unbroken line in FIG. 1, the volumetric flow can be varied approximately proportionally to the pressure applied at the nozzles. Because the flow speed, in turn, depends upon the pressure, as represented by the plot diagram or graph in FIG. 4, when the consumer characteristic remains the same, the flow speed cannot consequently be adjusted independently of the volumetric flow by varying the power of the blower. This has the consequences for the flotation height or level of the sheet guided via the air cushion guide, which were mentioned hereirnbetore in the introduction hereto. The overpressure present at the nozzle openings of the guide member is converted into flow speed, assuming a loss-free flow, in accordance with the following equation:

$$c = \sqrt{2 \times \left(\frac{\kappa}{\kappa - 1}\right) \times \left(\frac{p_v}{\rho_v}\right) \times \left(1 - \frac{p_0^{\left(\frac{\kappa-1}{\kappa}\right)}}{p_v}\right) + c_0^2} \tag{1}$$

The accelerated air is propagated uniformly, due to the shape of the nozzles, between the guide member that includes the nozzle openings and the sheet guided thereabove. In accordance with the continuity equation $$Q_1 = Q_2 \tag{2}$$

according to which the volumetric flow through the nozzle openings, because of the chamber pressure $p_v$ applied thereat, is equivalent to the volumetric flow $Q_2$ under the sheet, there results, for a vertical cross section of the flow under the sheet, $$Q = b \times h \times c \tag{3}$$

and, thus, for the flotation height or level,

For the relationships given above, the symbols have the following meanings:

$\kappa$=isentropic exponent $\rho_v$=density of the air at the initial or supply pressure of the chamber $p_0$=pressure of the air flow under the sheet (equivalent to atmospheric pressure)

$p_v$=initial or supply pressure in the chamber $c_0$=air speed in the box

Q=volumetric flow b=width of the cross section h=flotation height or level c=flow speed the quotient of the volumetric flow and the flow speed is varied, or in other words if the volumetric flow is increased but the flow speed is not simultaneously increased as well, or if the volumetric flow is increased markedly disproportionately relative to the flow speed.

Because, as noted hereinbefore, the flow speed is dependent upon the pressure $p_v$ at the nozzle openings, the pressure should accordingly be variable independently, or in other words not in proportion to the volumetric flow through the nozzles, in order to achieve the objective of the invention. In accordance with the exemplary embodiment of the invention shown in FIG. 5, this is made possible in that the number of active nozzle openings covered by the guide material is variable. To this end, the chamber 13 disposed under the guide baffle 13*b* and together therewith forming the guide member of an air cushion guide is provided with a plurality of individual subchambers 16*a, b*, and so forth, having air supply lines with electrically triggerable valves, respectively, connected thereto at the underside thereof. The air supply lines which discharge into the bottom plate 13*a* of the guide member are identified by reference characters 14*a, b* and *c*, for example, and the valves associated therewith are identified as 15*a, b* and *c*, respectively. Pespective groups of nozzles are associated with the corresponding chambers 16*a, b* and *c* of the guide member in the guide haffle, each of the nozzle groups, in the interest of greater clarity, being represented symbolically by only a single nozzle 12*a* to *c*, respectively. The chambers 16*a*, 16*c* are supplied jointly by a variable-rpm blower 17. The blower 17, like the valves 15*a*, 15*b*, 15*c*, and so forth, is connected to an electronic control unit 19, which is supplied with a desired or setpoint value of the flotation level or height $h_{soll}$ of the contact-freely guided sheet by the central control computer of the printing press to which the delivery system shown in FIG. 1 belongs.

The control unit 19 functions as follows:

If the flotation height is to be changed to lower values, the control unit 19 then turns off some of the valves 15*a* to *c*, and so forth, thus reducing the number of active nozzle openings. In this way, the volumetric flow of gas blown into the air cushion is reduced, while at the same time, because of the higher throttling action of the nozzle array, the pressure generated by the blower 17 rises, and thus the flow speed of the airstream emerging from the nozzles 12 rises as well. Consequently, an operating point for the air cushion guide is obtained at the point marked P2 in the graph of FIG. 3. This corresponds to the point of intersection of a somewhat flatter consumer characteristic curve A' with the unchanged generator characteristic curve B. If the flow speed under the sheet is to be adapted or matched simultaneously to the previous value, then the blower is regulated additionally to a lesser rpm, so that the generator characteristic curve B" and thus an operating point at the location marked P3 in the graph of FIG. 2 results.

It is clear that the guide member must be divided into individual subchambers 16*a, b, c*, and so forth in such a manner that no disturbing inhomogeneities in the flotation height or level of the sheet are produced.

Figure 5:
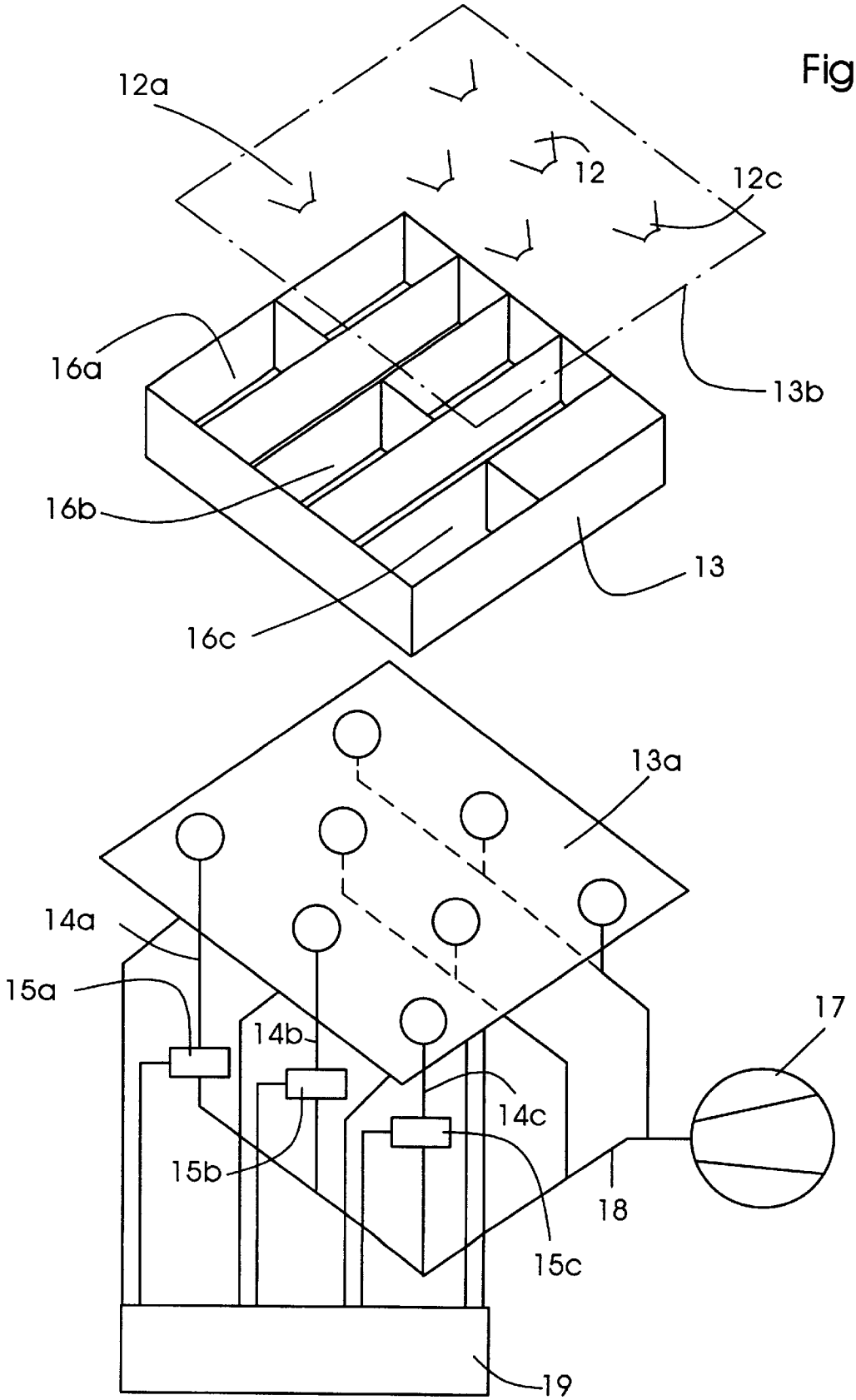
FIG. 5 is a schematic and diagrammatic sketch of a first exemplary embodiment of the invention.
Figure 6:
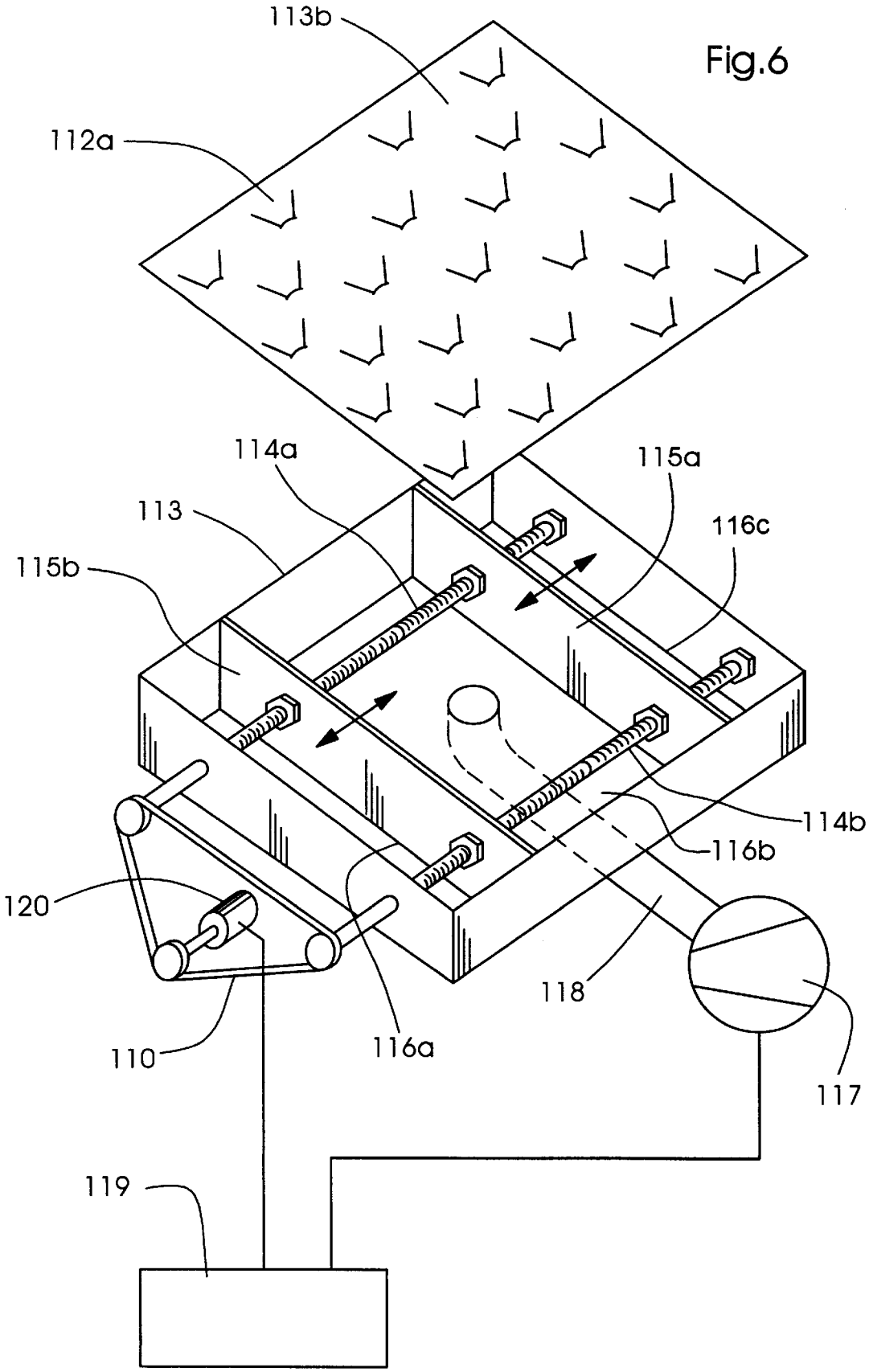
FIG. 6 is a sketch like that of FIG. 5 of a second exemplary embodiment of the invention.

Whereas, in the preceding exemplary embodiment according to FIG. 5, individual groups of nozzles, and thus in each case a discrete number of nozzle openings in the nozzle guido baffle, are supplied with blown or blast air and consequently switched to "active", in the next exemplary embodiment according to FIG. 6, a change in the number of active nozzle openings is accomplished by an infinitely variable gear. Features or elements therein which are identical to those shown in FIG. 6 are provided in FIG. 5 with reference numerals or characters which have been increased by 100 and will not be explained again. In FIG. 6, the chamber 113 of the guide member is subdivided by two inserted ribs 115*a* and 115*b* into three sections 116*a, b, c*, of which the niddle section 116*c* communicates with a blower 117 via a hose line 118. The two ribs 115*a* and 115*b* can be adjusted oppositely to one another with the aid of threaded spindles 114*a* and 114*b*, a motor 120 connected to the control unit 119, and a toothed belt 110. In this manner, the size of the two chambers 116*a* and 116*c*, which are not connected to the blower 117, can be varied, thereby deactivating the nozzles associated therewith and located thereabove.

In order to increase the volumetric flow and thus the flotation level or height of the sheet fed above the guide baffle 113*b*, the chambers 116*a* and 116*c* are accordingly made smaller by displacement of the ribs 115*a* and 115*b*, and contrarily, in order to decrease the volumetric flow and the flotation height of the respective sheet, the chambers 116*a* and 116*c* are made larger by suitably displacing the ribs 115*a* and 115*b*.

Figure 7A:
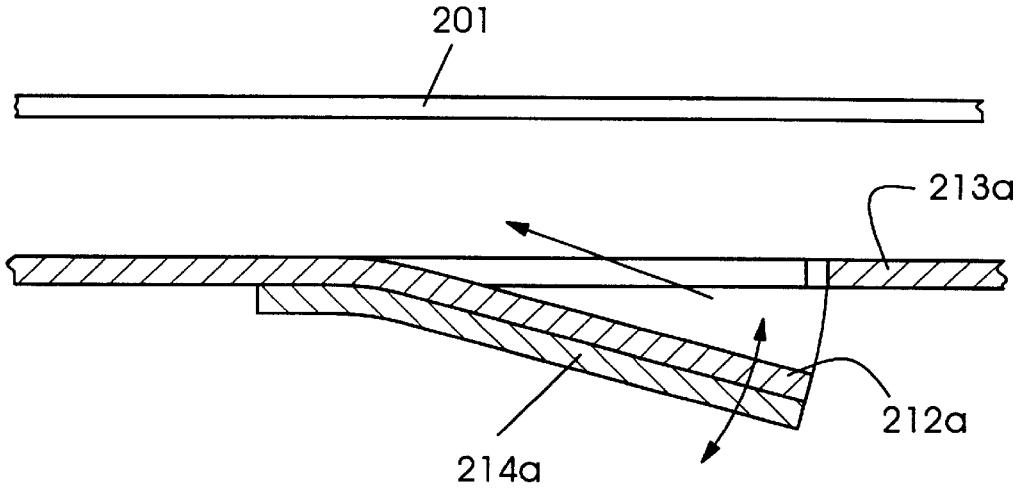
FIG. 7*a* is an enlarged fragmentary sectional view of FIG. 7*b*, which is a fragmentary diagrammatic and schematic sectional view of a third exemplary embodiment of the invention.
Figure 7B:
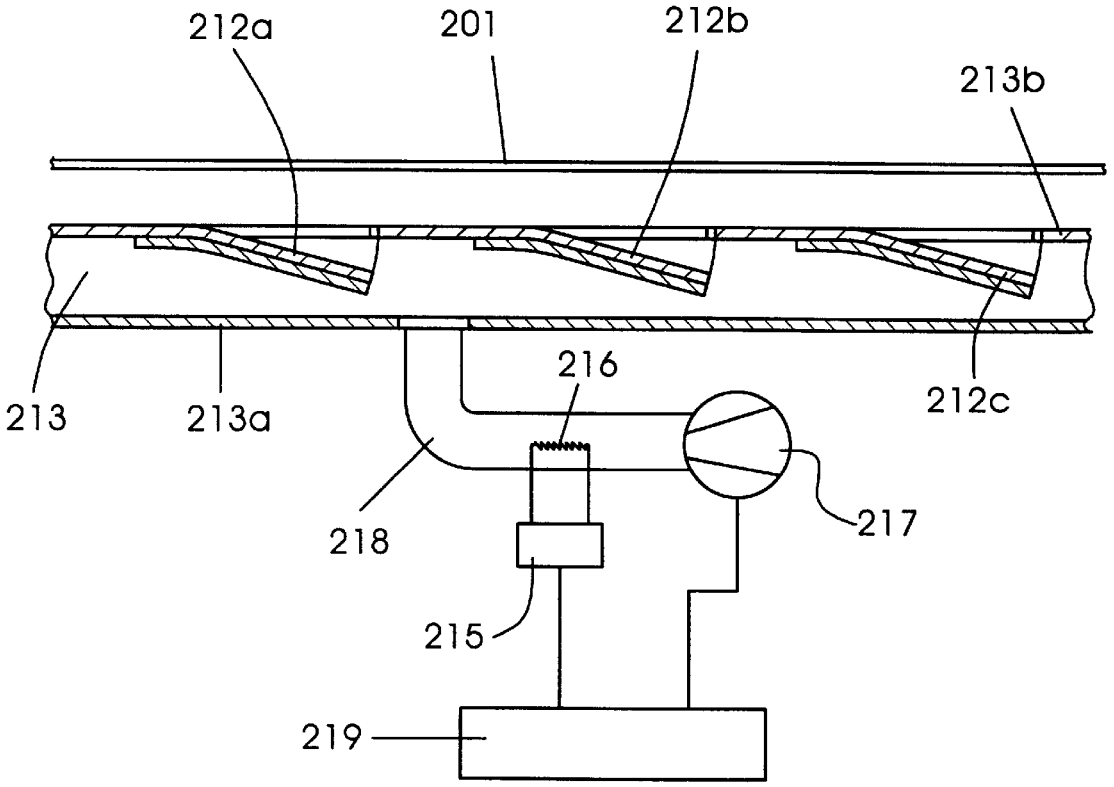

In the next exemplary embodiment shown in FIGS. 7*a* and *b*, the volumetric flow of the air cushion guide can be varied independently of the flow speed, because the cross sections of individual nozzle openings or groups of nozzle openings, or of all the nozzle openings, are variable. To that end, nozzle openings are formed in a conventional manner by an embossing/stamping process in the guide baffle 213*b* above which the sheet 201 floats, the embossing/stamping process forming tongues 212*a, b, c*, and so forth protruding inwardly into the guide member and directing the airstream of the overpressure air in the chamber 213 of the guide member so that it can reach underneath the guided sheet 201. The underside of the tongues 212*a, b, c*, and so forth, which for example are formed of sheet steel, have metal strips 214*a* of some other material, such as aluminum, adhesively secured thereto, so that, in the region of the movable tongues 212 of the nozzles, a bimetallic property is produced. At the same time, a heating coil 216 of a controllable heater 215 is accommodated in a supply tube 218, which connects the chamber 213 with the regulatable blower 217. By varying the heating output, the temperature of the air supplied to the chamber 213 can thus be varied, as a result of which the tongues 212/214 of the nozzles in the sheet guide baffle 213*b* are deformed, and correspondingly decrease or increase the cross section of the nozzle openings. The heating output and the rpm of the blower 217 are adjusted by the control unit 219 in such a manner that the flow speed c of the airstream emerging from the nozzles and the volumetric air flow Q can be adapted independently of one another to optimal conditions for the sheet 201.

Figure 8A:
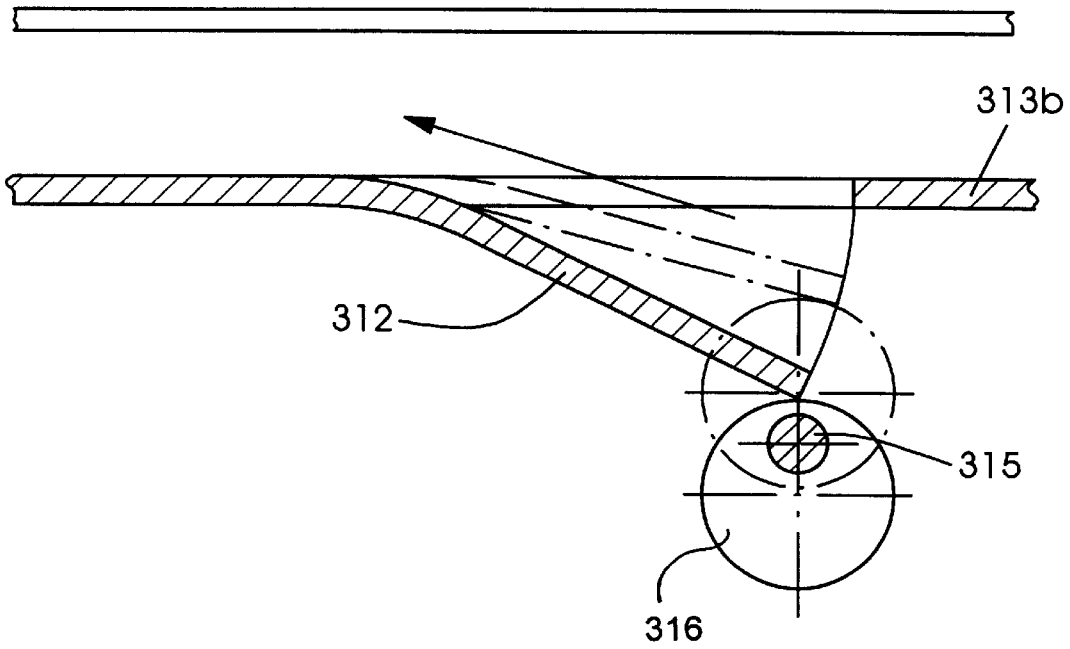
FIGS. 8*a* and 8*b* are fragmentary sectional views of alternative embodiments of the third exemplary embodiment of FIGS. 7*a* and 7*b*, for varying the cross section of the nozzles therein.

Controlled bending or warping of the resilient tongues of the nozzle openings can also be accomplished in other ways, however, such as are illustrated in FIG. 8*a*, wherein the tongues 312 of the nozzles in the guide baffle 313*b* of the guide member have eccentric disks 316 assigned thereto, which rotate about a shaft 315 and with the aid of which the flexible tongues 312 can be partly closed.

The shaft 315 is connected, for example, to a non-illustrated stepping motor, which in turn is also connected to a control unit by which the angular position of the shaft 315, and thus the cross-sectional area of the nozzles, and optionally the power of the compressed air supplier can be adjusted.

Figure 8B:
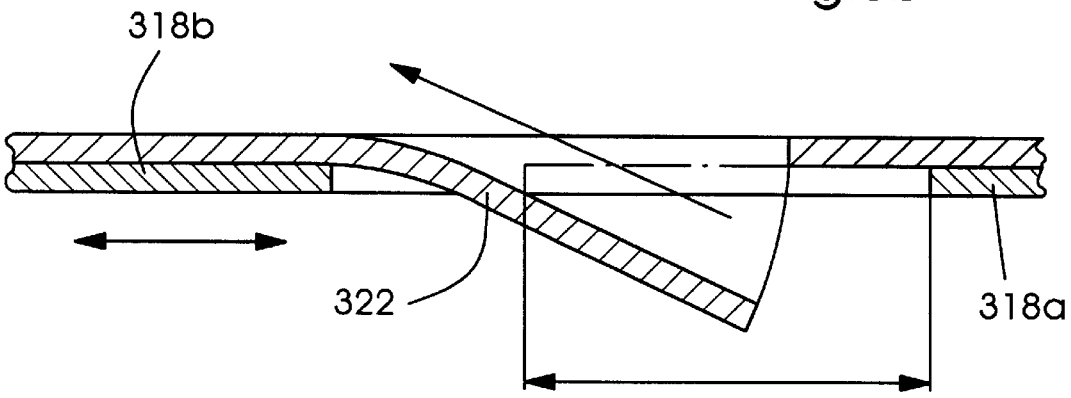

The cross-sectional area of the nozzle openings can naturally be varied by blocking members such as electrically actuatable slides 318, flaps, or the like, as well, as shown in FIG. 8*b*, without requiring the nozzle tongues themselves to be resiliently constructed and deformted.

Figure 9:
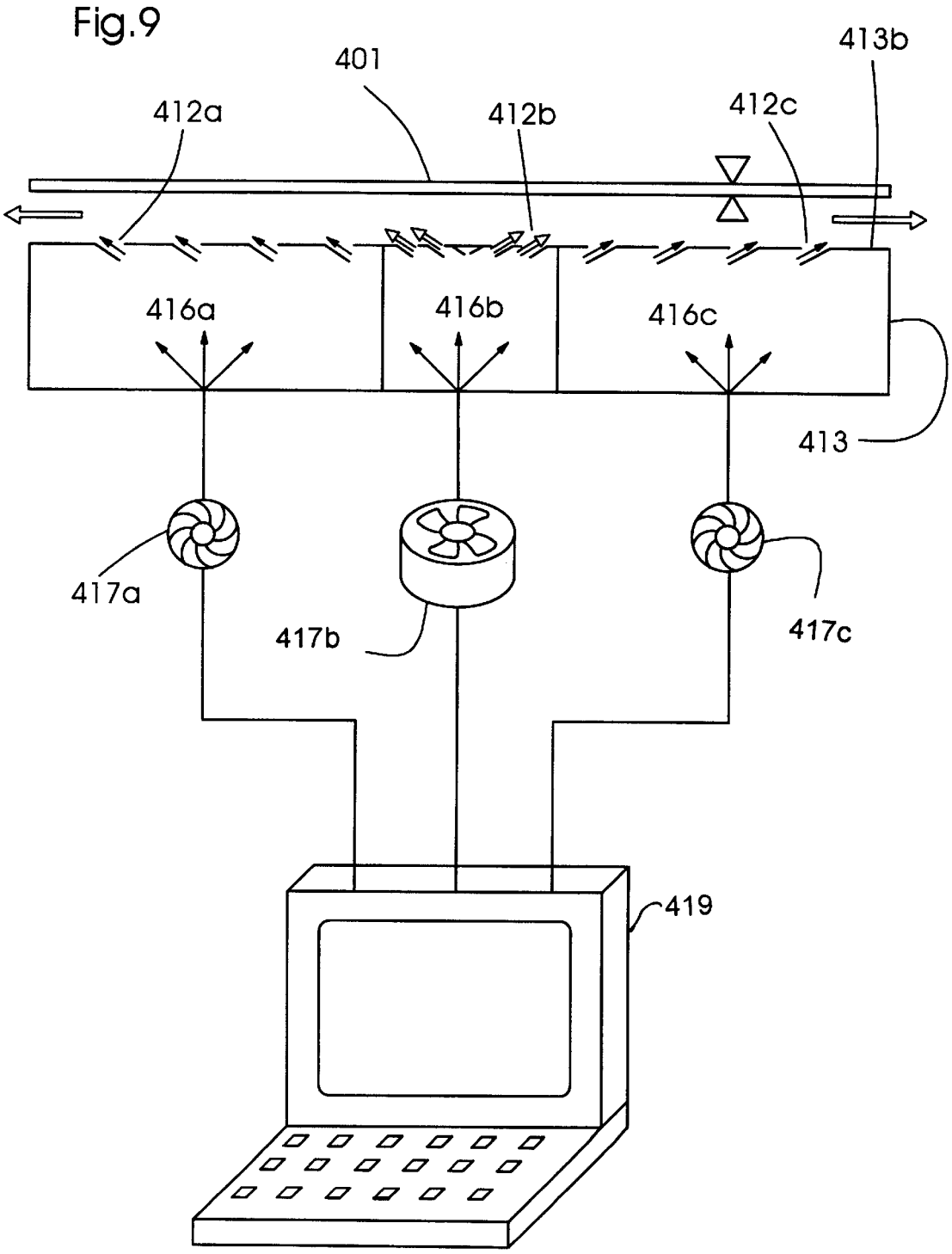
FIG. 9 is a schematic and diagrammatic sketch of a fourth exemplary embodiment of the invention.

In FIG. 9, a particularly preferred embodiment of the invention is shown, wherein the guide member 413, by which the sheet 401 is guided, is divided into three parallel chambers 416*a*, 416*b* and 416*c* extending side by side in the travel direction of the sheet, each of the chambers 416*a* to 416*c* being connected to its own air supplier.

The chambers 416*a* and 416*c* are each connected to a respective blower 417*a* and 417*c*, with which relatively high initial or supply pressures $p_0$ at low volumetric flows can be attained. The middle chamber 416*b* is supplied by an axial fan 417*b*, which already furnishes high volumetric air flows at even slight pressure differences. The boundaries of the three chambers need not extend in a straight line as shown in FIG. 9, but may instead have a zigzag course, so that different air flows emerging from the nozzles 412*a, b* and *c* of the guide baffle 413*b*, as described further hereinafter, can be mixed as well as possible under the guided sheet 401.

The chambers 416*a* and 416*c*, on the one hand, and the chamber 416*b*, on the other hand, have markedly different consumer characteristic curves. Correspondingly, volumetric flows of quite different magnitudes flow through the associated nozzles 412*a* and 412*c*, on the one hand, and 412*b*, on the other hand, and these flows have flow speeds which differ sharply from one another. By mixing the supporting air flows, a mean value of the flow speed for the added volumetric flows is established, based upon the mixing rule. By purposeful changes in the parameters in the chambers 416*a* and 416*c*, on the one hand, and 416*b*, on the other hand, it is now possible for the supporting air flow effectively acting upon the sheet and referred to the flow speed c, and the volumetric flow Q, to be adjusted independently of one another. This is illustrated in further detail hereinbelow in conjunction with the graph in FIG. 10, wherein the consumer characteristic curve A1 for the middle chamber 416*b* is shown as having a relativey steep course. At low pressure, a high volunietric flow is already achieved. Consequently, a large air volume with a low flow speed is blown under the sheet 401. This is accomplished by a large number of nozzles in the sheet guide baffle 413*a* or, in other words, a high nozzle density or by nozzles with openings having suitably large cross sections.

Figure 10:
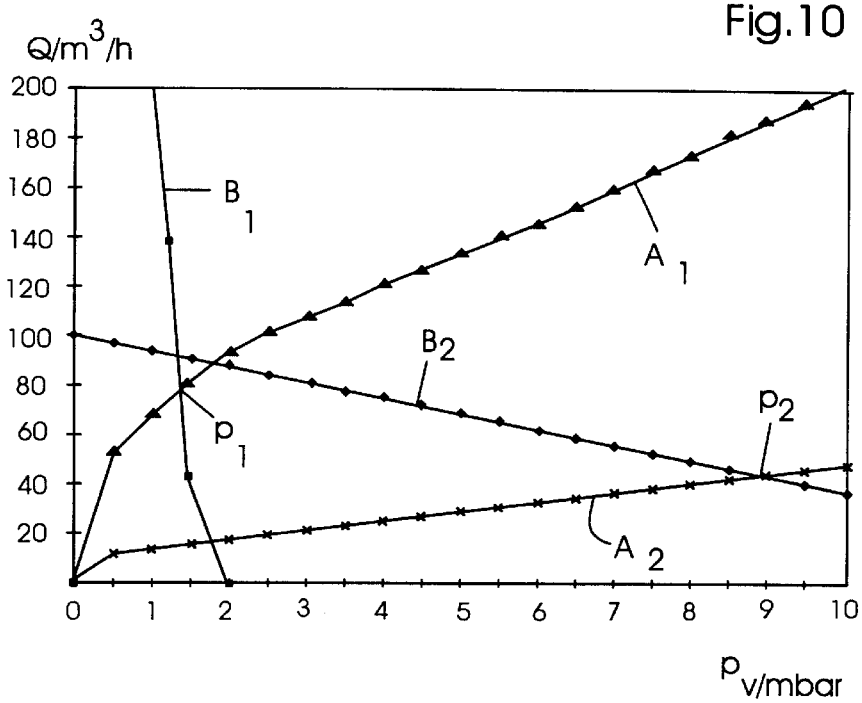
FIG. 10 is a plot diagram or graph showing two different pairs of respective generator and consumer characteristic curves of the air cushion guide of FIG. 9.

The consumer characteristic curves A2 of the two outer chambers 416*a* and 416*c*, conversely, have a relatively flat course. To force enough air through the nozzles, a high pressure difference is applied. Because the pilot or supply pressure in the chambers 416*a* and 416*c* is consequently quite high, the air flows at high speed out of the nozzles associated with these chambers. This is accomplished by a low nozzle density or by providing nozzles with very narrow throttle cross sections. In the graph of FIG. 10, the characteristic curves of the chambers 416*a, b* and *c* and the blower 417 are plotted jointly. For the two different types of chambers, in conjunction with the two different blowers or fan types, the operating points marked P1 and P2 then result.

Due to the arrangement of the nozzles 412*b*, the air flowing out of the middle chamber 416*b* is given a flow direction oriented towards the two outer chambers 416*a* and *c*. The large air volume of the middle chamber 416*b* flows at low speed between the guide baffle 413*a* and the sheet 401. This middle chamber 416*b* is relatively narrow.

Above the two outer chambers 416*a* and 416*c*, the air emerging from the middle chamber 416*b* mixes with that from the chambers 416*a* and 416*c*. The volumetric currents are added together there, and the speeds mix in a manner that is weighted in accordance with the proportions of the volumetric currents. If very different consumer characteristic curves for the chambers are selected, there results a broad spectrum of the operating points attainable by mixing the two airstreams. In this manner, simply by only a suitable control of the rpm of the gas blower 417*a* and *c* or of the axial tan 417*b*, the volumetric flow blown into the air cushion and the mean flow speed $\bar{c}$ established in accordance with the mixing rule can then be adjusted independently of one another, and thus the flotation height or level of the sheet 401 above the guide baffle 413*b* can also be selected as required within broad limits. The extent to which the flotation height or level can be varied naturally depends upon the ratio of the cross-sectional areas of the nozzle openings of the chambers 416*a* and *c*, on the one hand, and 416*b*, on the other hand. A factor of approximately 2 to 20 is desired.

Figure 11:
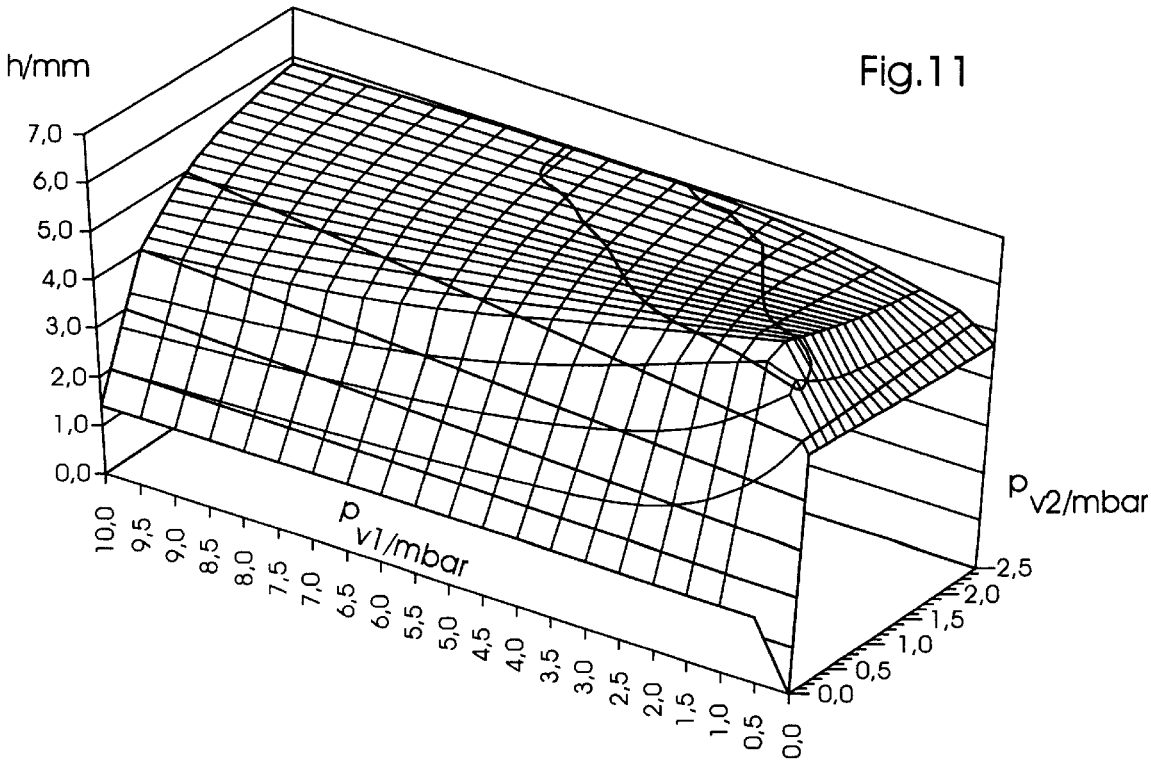
FIG. 11 is a plot diagram or graph showing the flotation level or height (h) of the sheet guided by the embodiment of the air cushion guide of FIG. 9, in a two-dimensional view, in accordance with or as a function of the pilot or supply pressures $p_v$ 1 and $p_v$ 2 in the respective chambers 416*a* and *c*, or the one hand, and 116*b*, on the other hand.

The flotation height or level of the sheet established in accordance with or based upon this formula is shown in the three-dimensional graph of FIG. 11. The pressures in the chambers 416*a* and *c*, on the one hand, and 416*b*, on the other hand are plotted on the two abscissas, while the flotation level or height is plotted on the ordinate. It is assumed that the air generators and the air consumers have the characteristic curves shown in the graph of FIG. 10. It is apparent from the graph that the flotation height of the sleet can be changed somewhat by a factor of three, by varying the pressures in the chambers 416*a, b* and *c*, the corresponding blowers 417*a, b* and *c* being varied by the control unit 419, for example, in accordance with the specification of the desired flotation height. The adaptation or matching can be performed in accordance with the following parameters:

a) The pressure in the middle chamber 416*b* is changed. As a result, the volumetric flow of the entire air cushion guide changes very sharply, while the mean speed of the air flow remains virtually unchanged. The flotation height thereat changes approximately in proportion to the change in the volumetric flow originating in the middle chamber 416*b*.

b) Stability: Observations indicate that the resistance offered by the air cushion guide to the sheet entering the air cushion and thus to an approach to the sheet guide baffle 413*b* depends above all upon the flow speed. The higher the flow speed, the greater is the tendency of the airstream to stay where it is and thus the higher is the reaction force against disturbances of the air cushion. To increase the guidance stability, the pressure of the outer chambers 416*a* and 416*b* can therefore be increased.

Thin papers react to excessively high flow speeds by high-frequency vibrations. The pressure in the two outer chambers can be reduced thereat In order to accomplish a "gentler" guidance at approximately the same floating level.

Figure 12A:
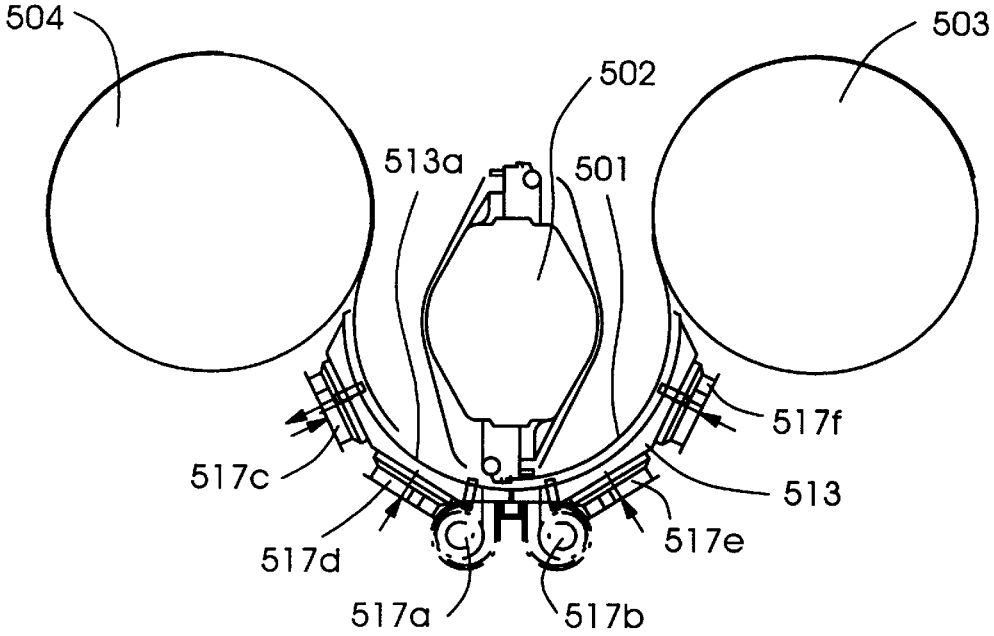
FIG. 12*a* is a somewhat simplified basic sketch of an air cushion guide according to the invention in the vicinity of a sheet turning drum between two impression cylinders of a sheet-fed printing press.
Figure 12B:
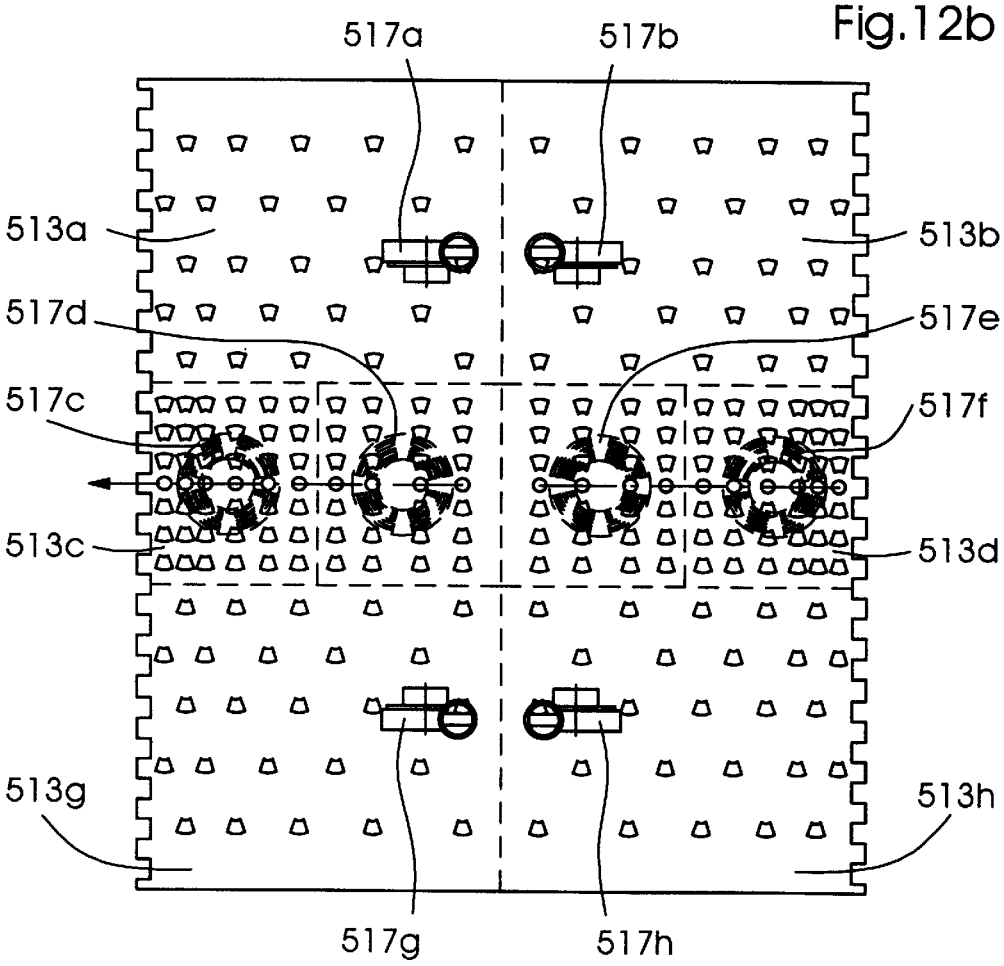
FIG. 12*b* is a fragmentary plan view of FIG. 12*a* as seen from below in the latter, and showing a sheet guide baffle of the air cushion guide according to the invention.

A further preferred exemplary embodiment of the invention is illustrated in FIGS. 12*a* and *b*, wherein the sheet 501 to be printed, for example, on the rear side thereof in perfecter printing, is fed from a transfer drum 502 between two impression cylinders 503 and 504. To assure reliable, smearfree sheet travel between the printing units, an air cushion guide of semicircular cross section is disposed below the transfer drum, spaced slightly apart trom the arc described by the grippers of the drum 502. The plan view on the likewise semicircular sheet guide baffle of this air cushion guide is shown in FIG. 12*b*. The broken lines therein indicate that the chamber 513 below the nozzle openings is subdivided into various regions 513*a* to 513*h*, and respective air generators 517*a* to *h* are assigned to each partial chamber or subchamber. The air generators 513*a* and *b* and 513*g* and *h* are gas blowers, which supply a relatively high initial or supply pressure p to the few nozzles disposed on the outer edges of the sheet guide. Conversely, the four middle regions disposed in succession in the sheet travel direction, i.e., 513*c, d, e* and *f*, and the nozzles associated therewith and disposed so close together on the sheet guide baffle that they engage one another, are supplied by four axial fans 517*c, d, e* and *f*, which generate a high volumetric flow. The adjustment of the flotation height h of the sheet 501 above the sheet guide baffle is effected in a manner similar to that described for the exemplary embodiment of FIG. 9.

I claim:

1. An air cushion guide for sheet or web-formed material, comprising:

at least one guide member formed with nozzle openings through which air is blown between said guide member and the guided material for supporting the guided material on a supporting air cushion located above said guide member;

said guide member formed with at least two chambers extending side by side along a direction of travel of the guided material;

said nozzle openings including a first group of nozzle openings characterizable by a first characteristic curve and communicating with a first one of said chambers, said first characteristic curve relating volumetric air flow emerging from said first group of nozzles to a pressure in said first one of said chambers;

said nozzle openings including a second group of nozzle openings characterizable by a second characteristic curve and communicating with a second one of said chambers, said second characteristic curve relating volumetric air flow emerging from said second group of nozzles to a pressure in said second one of said chambers;

said second characteristic curve being different from said first characteristic curve;

at least one of two variables consisting of volumetric air flow emerging from the nozzles and flow speed of the air between the guide member and the guided material being adjustable independently of one another.

2. The air cushion guide according to claim 1, wherein an active number of said nozzle openings covered by the guided material is variable.

3. The air cushion guide according to claim 2, wherein said guide member has a plurality of groups of said nozzles, each group of said nozzles being supplied with blowing air and being cut off therefrom in a separately connectible and disconnectible manner, respectively.

4. The air cushion guide according to claim 3, wherein said groups of said nozzles are connected to a common blown air generator via control valves.

5. The air cushion guide according to claim 3, wherein each of said groups of said nozzles is connected to a separate blown air generator.

6. The air cushion guide according to claim 1, wherein said first group of nozzle openings is supplied by blown air at a pressure that is regulatable independently from a pressure that is supplied to said second group of nozzle openings.

7. The air cushion guide according to claim 6, wherein the sums of cross sectional areas of nozzle openings of both of said groups differ from one another by a factor of at least two.

8. The air cushion guide according to claim 6, wherein said groups of said nozzles, respectively, are connected to different types of blown air generators.

9. The air cushion guide according to claim 8, wherein said types of blown air generators are selected from the group consisting of blowers, ejectors and axial fans.

10. The air cushion guide according to claim 1, including an electronic control unit into which one of a nominal flotation height of the material guided by the air cushion, and of an extent of variation of said nominal flotation height is inputtable as a reference value, said control unit being operatable for ascertaining at least one of a set of controlled values for a variation in air volume flowing out of said nozzle openings, and a variation in flow speed between said guide member and the guide material.

11. In a delivery system of a sheet-fed offset printing press, an air cushion guide for sheet or web-formed material, comprising:

at least one guide member formed with nozzle openings through which air is blown between said guide member and the guided material for supporting the guided material on a supporting air cushion located above said guide member;

said guide member formed with at least two chambers extending side by side along a direction of travel of the guided material;

said nozzle openings including a first group of nozzle openings characterizable by a first characteristic curve and communicating with a first one of said chambers, said first characteristic curve relating volumetric air flow emerging from said first group of nozzles to a pressure in said first one of said chambers;

said nozzle openings including a second group of nozzle openings characterizable by a second characteristic curve and communicating with a second one of said chambers, said second characteristic curve relating volumetric air flow emerging from said second group of nozzles to a pressure in said second one of said chambers;

said second characteristic curve being different from said first characteristic curve; and wherein:

at least one of two variables consisting of volumetric air flow emerging from the nozzles and flow speed of the air between the guide member and the guided material are adjustable independently of one another.

12. In a region wherein one of a sheet transfer device and a sheet turning device is located between two impression cylinders of a sheet-fed offset printing press, an air cushion guide for sheet or web-formed material, comprising:

at least one guide member formed with nozzle openings through which air is blown between said guide member and the guided material for supporting the guided material on a supporting air cushion located above said guide member;

said guide member formed with at least two chambers extending side by side along a direction of travel of the guided material;

said nozzle openings including a first group of nozzle openings characterizable by a first characteristic curve and communicating with a first one of said chambers, said first characteristic curve relating volumetric air flow emerging from said first group of nozzles to a pressure in said first one of said chambers;

said nozzle openings including a second group of nozzle openings characterizable by a second characteristic curve and communicating with a second one of said chambers, said second characteristic curve relating volumetric air flow emerging from said second group of nozzles to a pressure in said second one of said chambers;

said second characteristic curve being different from said first characteristic curve; and wherein:

at least one of two variables consisting of volumetric air flow emerging from the nozzles and flow speed of the air between the guide member and the guided material are adjustable independently of one another.

13. A method for adjusting a flotation height of sheet or web material guided in an air cushion guide, which comprises:

providing at least one guide member formed with nozzle openings;

providing the guide member with a first chamber communicating with a first group of the nozzle openings and a second chamber communicating with a second group of the nozzle openings, the first chamber and the second chamber extending side by side along a direction of travel of guided material;

configuring the first group of nozzle openings and configuring the second group of nozzle openings such that a first characteristic curve, relating volumetric air flow emerging from the first group of nozzles to a pressure in the first chamber, is different than a second characteristic curve, relating volumetric air flow emerging from the second group of nozzles to a pressure in the second chamber;

supporting the guide material on a supporting air cushion via the guide member;

blowing air beneath the guide material via nozzles in the guide member; and varying a quotient between volumetric air flow blown in through the nozzles and flow speed of the air between the guide member and the guide material.

14. The method according to claim 13, which comprises:

configuring the first group of nozzle openings and configuring the second group of nozzle openings such that the first characteristic curve and the second characteristic curve differ from each other by at least a factor of two; and varying a ratio of pressure of blowing air supplied to the first group of nozzle openings and pressure of blowing air supplied to the second group of nozzle openings.

15. An air cushion guide for sheet or web-formed material, comprising:

at least one guide member formed with nozzle openings through which air is blown between said guide member and the guided material for supporting the guided material on a supporting air cushion located above said guide member, said guide member formed with a first chamber communicating with a first group of said nozzle openings and a second chamber communicating with a second group of said nozzle openings; and an electronic control unit operable for ascertaining a set of control values selected from the group consisting of control values for varying air volume flowing out of said nozzle openings, and control values for varying flow speed between said guide member and the guide material, said set of control values for independently varying pressure in said chambers.

16. An air cushion guide for sheet or web-formed material, comprising:

at least one guide member formed with nozzle openings through which air is blown between said guide member and the guided material for supporting the guided material on a supporting air cushion located above said guide member;

said guide member formed with at least two chambers extending side by side along a direction of travel of the guided material;

said nozzle openings including a first group of nozzle openings characterizable by a first characteristic curve and communicating with a first one of said chambers, said first characteristic curve relating volumetric air flow emerging from said first group of nozzles to a pressure in said first one of said chambers;

said nozzle openings including a second group of nozzle openings characterizable by a second characteristic curve and communicating with a second one of said chambers, said second characteristic curve relating volumetric air flow emerging from said second group of nozzles to a pressure in said second one of said chambers;

said second characteristic curve being different from said first characteristic curve;

said first group of nozzle openings supplied by blown air at a pressure that is regulatable independently from a pressure that is supplied to said second group of nozzle openings.

17. A method for adjusting a flotation height of sheet or web material guided in an air cushion guide, which comprises:

providing at least one guide member formed with nozzle openings;

providing the guide member with a first chamber communicating with a first group of the nozzle openings and a second chamber communicating with a second group of the nozzle openings, the first chamber and the second chamber extending side by side along a direction of travel of guided material;

configuring the first group of nozzle openings and configuring the second group of nozzle openings such that a first characteristic curve, relating volumetric air flow emerging from the first group of nozzles to a pressure in the first chamber, is different than a second characteristic curve, relating volumetric air flow emerging from the second group of nozzles to a pressure in the second chamber;

supporting the guide material on a supporting air cushion via the guide member;

blowing air beneath the guide material via nozzles in the guide member; and varying a ratio of pressure of blowing air supplied to the first group of nozzle openings and pressure of blowing air supplied to the second group of nozzle openings.

* * * * *